United States Patent [19]

Gailitis

[11] 4,247,049

[45] Jan. 27, 1981

[54] ACTUATOR BUTTON HAVING SWIRL-INDUCING VANE PLATE

[75] Inventor: Adolph R. Gailitis, Winchester, Mass.

[73] Assignee: Summitt Packaging Systems, Inc., Manchester, N.H.

[21] Appl. No.: 63,820

[22] Filed: Aug. 6, 1979

[51] Int. Cl.[3] ..... B05B 1/34

[52] U.S. Cl. ..... 239/497

[58] Field of Search ..... 239/337, 340, 494–497

[56] References Cited

U.S. PATENT DOCUMENTS

| | | | |
|---|---|---|---|
| 1,229,030 | 6/1917 | Cecil | 239/495 |
| 2,220,227 | 11/1940 | Gifford | 239/495 |
| 2,736,607 | 2/1956 | Thompson | 239/495 |
| 2,924,394 | 2/1960 | Clark | 239/495 |
| 3,226,040 | 12/1965 | Briechle et al. | 239/496 |
| 3,330,070 | 7/1967 | Ferm et al. | 239/494 |

FOREIGN PATENT DOCUMENTS

| | | | |
|---|---|---|---|
| 656531 | 1/1963 | Canada | 239/337 |
| 280403 | 1/1952 | Switzerland | 239/495 |

*Primary Examiner*—Robert B. Reeves
*Assistant Examiner*—Michael J. Forman
*Attorney, Agent, or Firm*—Dallett Hoopes

[57] ABSTRACT

Actuator button is provided with a vane plate for deflecting the product coming into swirl chamber within the actuator button insert. This eliminates the need for a central post and molded swirl chamber formed on the post or insert as required by the prior art.

2 Claims, 13 Drawing Figures

ACTUATOR BUTTON HAVING SWIRL-INDUCING VANE PLATE

BACKGROUND OF THE INVENTION

1. Field of the Invention

This invention relates to actuator buttons for aerosol containers. More specifically, the invention relates to aerosol actuators containing mechanical break-up means for atomizing the aerosol product to a high degree.

2. Description of the Prior Art

The prior art is replete with examples of so-called mechanical break-up buttons for aerosol containers. These buttons normally comprise a cylindrical body having an inlet at the bottom adapted to fit over the aerosol valve stem. At the side of the cylindrical body is a discharge orifice connected with the inlet by passage means inside the body.

Often, to comprise the discharge the body of the actuator is formed with a cylindrical recess which receives a plastic cup-shaped insert open-end first and that insert has the discharge opening in its outer or closed end. Structure has been provided to see that the product (that is, the aerosol liquid) undergoes some kind of a swirl action as it passes through the cavity formed within the insert. Examples of such structure are shown, for instance, in the U.S. Pat. No. 3,174,692, issued Mar. 23, 1965 to E. H. Green. Usually in such structure, the swirl of the product is effected in a recess on the end of a plug comprising part of the actuator body and which is disposed inside the insert. Further examples are: U.S. Pat. No. 3,129,893, issued Apr. 21, 1964 to Green; U.S. Pat. No. 3,146,737, issued Dec. 17, 1968 to Venus; U.S. Pat. No. 3,519,210, issued May 7, 1970 to Duplain; U.S. Pat. No. 3,785,571, issued Jan. 15, 1974 to Hoening; U.S. Pat. No. 3,994,442, issued Nov. 3, 1976 to Hoening; and U.S. Pat. No. 4,036,439, issued July 19, 1977 to Green. Clearly, the tangential imprint can just as well be formed on the inside of the end wall of the insert to effect the same purpose, that is, a central swirl in the insert chamber. Often, the recess has taken the form of a kind of cross or "swastika" having tangential arms. The swirl is preferably effected immediately prior to passage through the discharge orifice. It can be imagined that this swirl effects high shear and relative movement of the product particles so that there is mix break-up and atomization.

SUMMARY OF THE INVENTION

Under the present invention, a swirl is produced in the chamber within the insert by a special vane plate. This plate is sandwiched between the insert and an annular shelf formed at the inner end of the recess for the cup-shaped insert. The vane plate of the invention comprises a body having a product-deflecting vane, the vane being disposed in canted relationship to a radial plane through the valve body and adapted to direct to the side of the axis of the chamber to produce a rotary or swirled effect of the product. In devices of the invention, the width of the chamber is substantial—far greater than the swirl chamber previously molded into the top of the actuator button post. As this swirling product from this chamber is forced subsequently through the discharge orifice, it is forced to reduce in size and in accordance with the law of conservation of momentum, the particles adjacent the periphery of the swirl chamber greatly speed up the swirling action as the product moves through the narrower discharge orifice with resultant high atomization of the product outside the orifice.

BRIEF DESCRIPTION OF THE DRAWINGS

Further objects and features of the invention will be apparent from the following specification and drawings, all of which disclose a non-limiting form of the invention. In the drawings.

DESCRIPTION OF THE PREFERRED EMBODIMENTS

Figure 1:
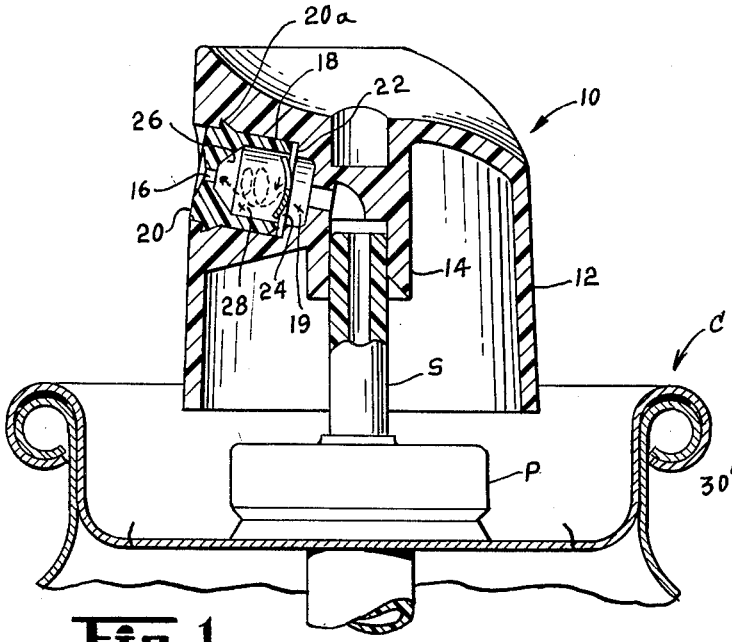
FIG. 1 is a sectional view of an actuator button embodying the invention.

An aerosol container, partially shown in FIG. 1 is generally designated C. It includes at its upper end a valve pedestal P with an upstanding central stem S. The actuator button embodying the invention is generally designated 10 in FIG. 1. It comprises a generally cylindrical plastic body 12 having at its lower end an inlet sleeve 14 which is adapted to be snugly received onto the stem S. The button actuator orifice is connected through passage means to be described to the inlet sleeve 14 and the orifice is generally designated 16.

As shown, the button is formed in its front side with a generally cylindrical insert recess 18. The recess is reduced to form a well 19 surrounded by an annular shelf 22.

A disc-like vane plate 24 is disposed in the insert recess 18 and bottoms against annular shelf 22. It is held in position by the open end of a cup-shaped insert 20 which may be of molded plastic and contain an annular spur **20*a* which engages the wall of the insert recess to hold the insert in position. The front wall of the insert 20 is formed with an interior bevel 26 and thereby defines a cylindrical cavity 28 having bevelled edges 26 adjacent the discharge orifice 16**.

Figure 2:
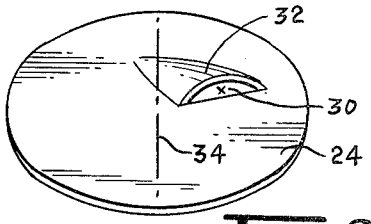
FIG. 2 is a perspective view greatly enlarged, of a vane plate in accordance with the invention.

Various forms of the vane plate 24 will now be described. As shown in FIG. 2, the vane plate 24 may be a stamping or the like having a single opening 30 formed at the end of a vane 32 shaped in the disc. The opening 30 is disposed on one side of the axis 34 of the disc and it can be seen that when the vane plate 24 is in position against the shelf 22 and product is moved through the opening 30, the vane and the shape of the chamber will impart to said incoming product a swirling or rotary action defined by the periphery of the interior of the insert 18. As the material in the cavity 28 moves up the bevel 26 and out the orifice 16, it will rotate with greater angular velocity in accordance with the law of conservation of angular momentum.

Figure 3:
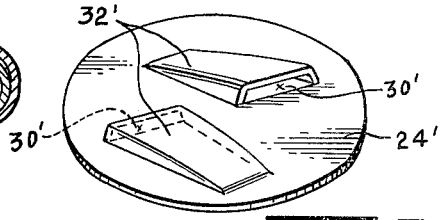
FIG. 3 is a perspective view of a modified vane plate.

The FIG. 3 version of the vane plate 24' includes a pair of openings 30' and the inclined vanes 32'. The vanes and shape of the chamber 28 impart a rotary motion to the product.

Figure 4:
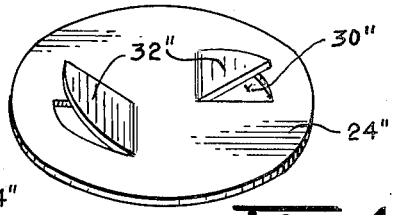
FIG. 4 is a perspective view of a further modification.
Figure 5:
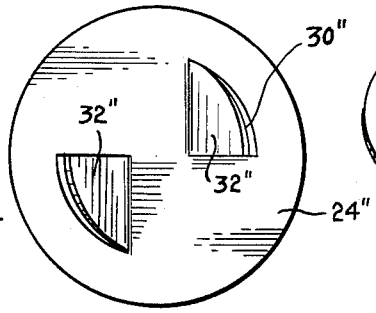
FIG. 5 is a top plan view of the FIG. 4 modification.

In the FIG. 4 version, the vanes 32'' are flaps punched out of the disc 24'' and arranged so that material that has passed through the opening 30'' of the disc will be imparted an annular movement in the chamber 28'. It will be seen that the general effect of the flaps 32'' and the shape of the cavity is to create a swirl (see arrow) in the swirl chamber 28.

Figure 7:
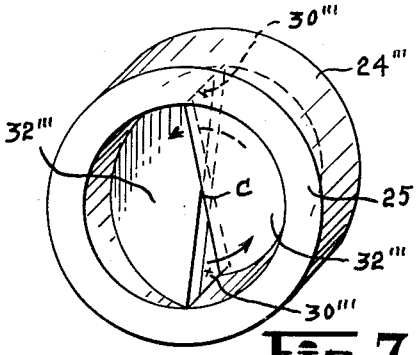
FIG. 7 is a greatly enlarged perspective view of the vane plate of FIG. 6.
Figure 6:
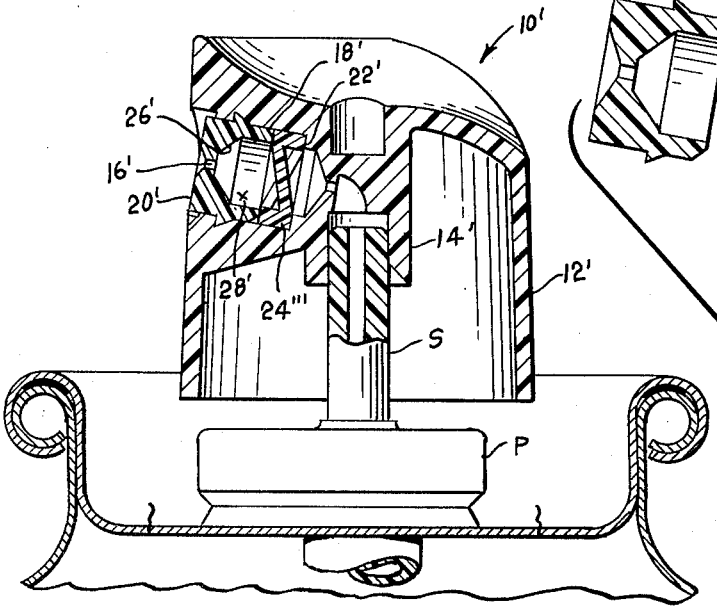
FIG. 6 is a sectional view comparable to FIG. 1 but showing the modified form of vane plate comprising a plastic molded body.
Figure 8:
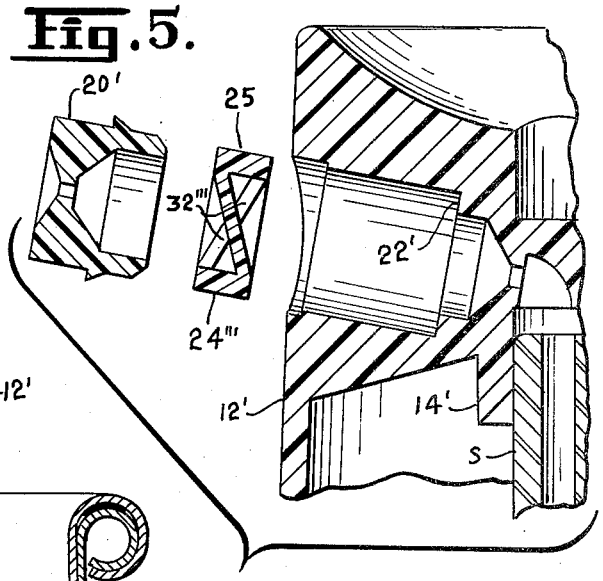
FIG. 8 is an exploded perspective view, greatly enlarged, of the arrangement of FIG. 6.
Figure 9:
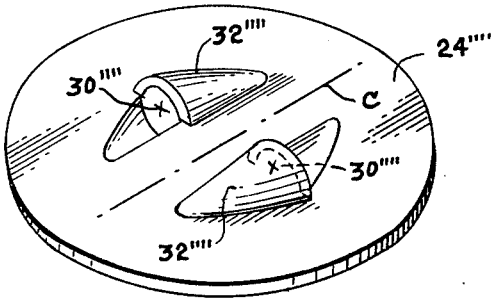
FIG. 9 is a perspective view of a further embodiment.

Turning now to FIG. 6, it will be seen that the construction is basically the same. The actuator button 10' is formed with a cylindrical body 12' and the sleeve 14' fits over the stem S snugly. The insert 20' is formed with a discharge orifice 16' and the recess 18' into which the insert fits is formed with an annular shelf 22'. A plastic vane plate 24''' is inserted against shelf 22' as shown in FIGS. 6 and 7 and is entrapped by the rim of the open end of the insert 20'.

The body 24''' may comprise an integral plastic ring 25 having a pair of semi-circular vanes 32''' touching in the center C of the vane plate 24''' but canted oppositely with respect to the radial plane through the center to leave openings 30'''. This effects, as best understood from FIG. 7, a rotary motion of the product in the chamber 28'. This rotary motion is speeded up as the mixture proceeds up the bevel 26' to discharge outlet 16'.

A further modification of a vane disc as contemplated by the invention is disclosed in FIGS. 9 through 13. This modification comprises a disc 24'''' preferably stamped of metal such as brass and having a pair of apertures 30'''' therein. As shown best in FIG. 9, these apertures are formed in the disc adjacent vane-like impressions 32'''' which are disposed on opposite sides of the center C of the disc. It will be noted from FIGS. 9 and 10 that each of the openings 30'''' face in a generally perpendicular direction to the plane of the disc 24'''' and are formed at each of upward and downwardly deflected vanes. The vanes 32'''' cooperate to direct the flow of product through the opening 30'''' in a more or less tangential direction with respect to the disc 24'''' so that the result is a swirl-type action inside the cavity 28 within the insert 20 (FIG. 1) when the disc of FIGS. 9 through 13 is used in such an arrangement.

Figure 10:
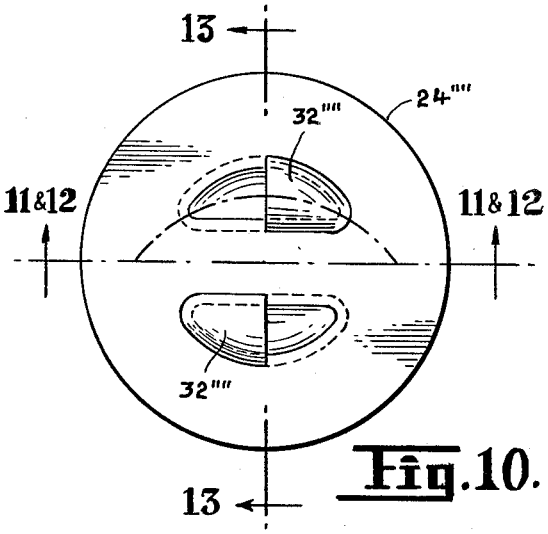
FIG. 10 is a top plan view of the FIG. 9 embodiment.
Figure 11:
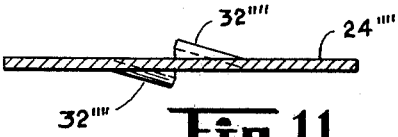
FIG. 11 is a sectional view taken on the line 11—11 of FIG. 10.
Figure 12:
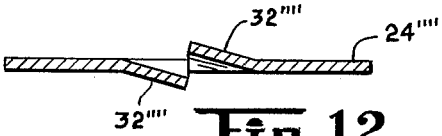
FIG. 12 is a sectional view taken on the line 12—12 of FIG. 10.
Figure 13:
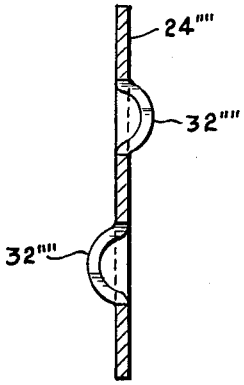
FIG. 13 is a sectional view taken on the line 13—13 of FIG. 10.

Moreover, the outer margin of the vanes of the disc 24'''' as shown in FIG. 10 are arcuate to even further assist in the formation of a swirl-type action.

Thus, it will be seen that the invention is susceptible of many changes, some of which are described herein. It should be understood, therefore, that the invention claimed is to be defined only by the following claim language and equivalents thereof.

I claim:

1. An actuator button for an aerosol comprising a plastic molded body having an inlet opening adapted to fit over the discharge stem of an aerosol can, a discharge opening connected to said inlet of the body and being shaped as a cylindrical hollow having a bottom annular shelf, a vane disc disposed snugly in the hollow against the shelf, the vane disc comprising a molded plastic body including a pair of semi-circular vanes tangent at the center of the disc and disposed generally transverse of the disc but angled oppositely with respect to a radial plane passing through the point of tangency, and a circumferential ring molded integrally with the vanes; and a separate cup-shaped orifice insert having imperforate sidewalls defining a substantial swirl chamber disposed mouth-end first, into the hollow, its mouth engaging the outer end of the disc, the insert having a discharge orifice in the center of its outer end, whereby the liquid product entering the inlet moves into the hollow and is deflected by the vanes to swirl into the chamber and out the orifice in a fine mist.

2. An actuator button as claimed in claim 1 wherein the ring is, with respect to the axis of the hollow, axially coextensive with the vanes and the mouth of the cup-shaped insert contacts the ring about its margin.

* * * * *